US007718597B2

(12) United States Patent
Grainger et al.

(10) Patent No.: US 7,718,597 B2
(45) Date of Patent: May 18, 2010

(54) FABRIC SOFTENING COMPOSITION

(75) Inventors: David Stephen Grainger, Wirral (GB); Llyr Glyndwr Griffiths, Wirral (GB); John Francis Hubbard, Wirral (GB); Gijsbert Kroon, Hardinxveld Giessendam (NL)

(73) Assignee: The Sun Products Corporation, Wilton, CT (US)

( * ) Notice: Subject to any disclaimer, the term of this patent is extended or adjusted under 35 U.S.C. 154(b) by 223 days.

(21) Appl. No.: 11/885,534

(22) PCT Filed: Jan. 31, 2006

(86) PCT No.: PCT/EP2006/000857

§ 371 (c)(1),
(2), (4) Date: Apr. 4, 2008

(87) PCT Pub. No.: WO2006/094582

PCT Pub. Date: Sep. 14, 2006

(65) Prior Publication Data

US 2008/0280807 A1 Nov. 13, 2008

(30) Foreign Application Priority Data

Mar. 4, 2005 (GB) ..... 0504536.4

(51) Int. Cl.
*C11D 3/37* (2006.01)

(52) U.S. Cl. ..... 510/473; 510/470

(58) Field of Classification Search ..... 510/470, 510/473

See application file for complete search history.

(56) References Cited

U.S. PATENT DOCUMENTS

| | | | | |
|---|---|---|---|---|
| 5,126,060 | A * | 6/1992 | Puentes-Bravo et al. | 510/526 |
| 5,290,459 | A * | 3/1994 | Puentes-Bravo et al. | 510/520 |
| 5,880,084 | A | 3/1999 | Ewbank et al. | 510/475 |
| 6,379,394 | B1 | 4/2002 | Chilou et al. | 8/137 |
| 6,579,840 | B1 | 6/2003 | Heltovics | 510/276 |
| 6,653,271 | B2 * | 11/2003 | Hage et al. | 510/312 |
| 6,740,713 | B1 * | 5/2004 | Busch et al. | 525/417 |
| 6,764,986 | B1 * | 7/2004 | Busch et al. | 510/101 |
| 6,827,795 | B1 | 12/2004 | Kasturi et al. | 134/42 |
| 6,972,276 | B1 * | 12/2005 | Besselievre et al. | 510/101 |
| 7,601,681 | B2 * | 10/2009 | Smets et al. | 510/475 |
| 2003/0045442 | A1 * | 3/2003 | Hage et al. | 510/302 |
| 2003/0104964 | A1 | 6/2003 | Cooper et al. | 510/327 |
| 2003/0224495 | A1 | 12/2003 | Franke et al. | 435/136 |
| 2004/0021473 | A1 | 2/2004 | Tsai et al. | 524/716 |
| 2004/0142840 | A1 * | 7/2004 | de Buzzaccarini et al. | 510/296 |
| 2004/0214736 | A1 | 10/2004 | Modi | 510/238 |
| 2006/0014655 | A1 * | 1/2006 | Smets et al. | 510/101 |
| 2006/0217287 | A1 * | 9/2006 | Zhu et al. | 510/515 |
| 2006/0223739 | A1 * | 10/2006 | Zhu et al. | 510/515 |
| 2008/0032910 | A1 * | 2/2008 | Smets et al. | 510/342 |

FOREIGN PATENT DOCUMENTS

| | | |
|---|---|---|
| EP | 0 331 237 | 2/1994 |
| EP | 0 385 749 | 4/1996 |
| EP | 0 596 580 | 4/1997 |
| EP | 0 501 714 | 5/1997 |
| GB | 2 043 646 | 10/1980 |
| WO | 01/46360 | 6/2001 |
| WO | 02/18611 | 3/2002 |
| WO | 2005/014767 | 2/2005 |
| WO | 2006/094580 | 9/2006 |

* cited by examiner

*Primary Examiner*—John R Hardee
(74) *Attorney, Agent, or Firm*—Sterne, Kessler, Goldstein & Fox P.L.L.C.

(57) ABSTRACT

Aqueous fabric softening composition having good high temperature stability comprising a cationic fabric softening compound and water soluble polysaccharide polymers comprising hydrophobic groups selected from aryl, alkyl, alkenyl, aralkyl each having at least 14 carbon atoms and cationic quaternary ammonium salt groups such that the cationic degree of substitution is from 0.01 to 0.2, the polymers having a molecular weight in the range from 100,000 to 700,000.

15 Claims, No Drawings

FABRIC SOFTENING COMPOSITION

TECHNICAL FIELD

The present invention relates to fabric softening compositions. In particular the invention relates to fabric softening compositions that are visually and Theologically appealing to consumers and exhibit good stability.

BACKGROUND AND PRIOR ART

It is well known to provide liquid fabric softening compositions that soften treated fabric. Such compositions are typically added to fabric in the rinse cycle of the wash process. It has been observed that consumer preference is for liquid fabric conditioners that appear thick and creamy, cued by having a high viscosity and a high opacity. Conditioners that appear thin and/or translucent/watery may be perceived as being cheap and ineffective, whereas conditioners that appear thick and creamy are perceived as premium products. One route to achieve this is through the use of polymeric viscosity modifiers.

Fabric conditioners comprising polymeric viscosity modifiers and cationic softening agent are known in the art. For example, WO-A1-02/081611 discloses a fabric softener composition for the treatment of textile fibre materials in domestic applications comprises a fabric softener and a water-soluble polyurethane obtainable by reaction of (a) a diisocyanate, with (b) a polyether containing at least one hydroxyl group, (c) optionally a diol derived from an aliphatic residue having from 2 to 12 carbon atoms, and (d) an agent introducing a water-solubilising group.

US 2004/0214736, U.S. Pat. No. 6,827,795, EP0501714, US 2003/0104964 and U.S. Pat. No. 5,880,084 disclose fabric softening compositions comprising Polyquaternium 24 which is a polymeric quaternary ammonium salt of hydroxyethyl cellulose reacted with lauryl dimethyl ammonium epoxide.

EP-A2-0385749 discloses fabric conditioning compositions comprising a quaternary ammonium softening material and a polymeric thickener. The thickener has a hydrophilic backbone and two hydrophobic groups attached thereto.

EP 331237 discloses an aqueous fabric conditioning composition comprising a fabric softener and a non-ionic cellulose ether, characterised in that said non-ionic cellulose ether has a sufficient degree of non-ionic substitution selected from the class consisting of methyl, hydroxyethyl and hydroxypropyl to cause it to be water-soluble and wherein said non-ionic cellulose ether is hydrophobically modified by further substitution with one or more hydrocarbon radicals having abut 10 to 24 carbon atoms, in an amount between 0.2% by weight and the amount which renders the cellulose ether less than 1% by weight soluble on water at 20° C. Preferred non-ionic cellulose ethers are hydrophobically modified hydroxyethyl cellulose (HMHEC) commercially available from Hercules Incorporated under the trade designation "Natrosol Plus". Specific examples of HMHEC which have been disclosed in fabric conditioning compositions are Natrosol Plus 330 and Natrosol Plus 331.

HMHEC polymers achieve viscosity build up by forming links between dispersed particles of the fabric conditioner system i.e. they act as "associative thickener". This is in contrast to "continuous phase thickeners" which work simply by thickening the continuous phase without any association. The benefits of HMHEC's are that they are more weight effective and hence are a more cost effective solution to achieving high product viscosities and also reduces material consumption i.e. better for the environment generally.

Where these polymers have been used previously with dilute products these have generally proven to be most effective at moderate temperatures (<37° C.) with softener actives that contain predominantly dialkyl cationic species. At higher temperatures the viscosity tends to decrease significantly before the compositions gel due to hydrolysis. This is disadvantageous especially if the target viscosity is relatively high.

In order to maintain the product viscosity, the HMHEC must remain associated or "bound" to the dispersed phase. If the polymer loses this binding, the hydrophobic moieties of the polymer can associate intramolecularly such that the viscosity drops below specification and the product becomes thin and more liable to separation. Another key issue regarding TEAQ type actives is that these actives may contain a significant amount of more water soluble mono-ester components. These components become even more water soluble as the temperature of the system is raised and this is believed to lead to the formation of micellar type structures in the continuous phase. These micelles are believed to facilitate the release of the hydrophobic chains of the polymer from the bilayer of the dispersed organic phase. In addition, as the ester linked actives hydrolyse under these high temperature conditions, the more hydrophobic triester and diester species break down to form the mono-ester products, thus exacerbating the problem even further.

The invention has been made with the above points in mind.

SUMMARY OF THE INVENTION

According to the present invention there is provided an aqueous fabric softening composition comprising a cationic fabric softening compound and water soluble polysaccharide polymers comprising hydrophobic groups selected from aryl, alkyl, alkenyl, aralkyl each having at least 14 carbon atoms and cationic quaternary ammonium salt groups such that the cationic degree of substitution is from 0.01 to 0.2, the polymers having a molecular weight in the range from 100,000 to 700,000.

The compositions of the invention provide improved high temperature stability compared to compositions containing the known HMHEC polymers.

Water-Soluble Polysaccharide Polymers

The water-soluble polysaccharide polymers comprise hydrophobic groups selected from aryl, alkyl, alkenyl having at least 14, preferably at least 16 carbon atoms and mixtures thereof and cationic quaternary ammonium salt groups such that the cationic degree of substitution is from 0.01 to 0.2, the polymers having a molecular weight in the range from 100,000 to 700,000, preferably 250,000 to 550,000. The polymers are preferably cellulose ethers.

The cationic ether modified, hydrophobically modified cellulose ether of the present invention may be produced from readily available materials. Such cellulose ethers are first alkylated with a long chain hydrophobic groups which are then quaternized with a nitrogen-containing compound. The hydrophobe and nitrogen containing compounds are separately attached to the backbone cellulose ether.

The starting materials include water-soluble polysaccharides such as cellulose ethers such as hydroxyethylcellulose (HEC), ethyl hydroxyethylcellulose (EHEC), hydroxypropylmethyl cellulose (HPMC), methyl cellulose (MC), hydroxypropylmethyl cellulose (HPMC), and methyl hydroxyethyl cellulose (MHEC), hydroxyethyl-methylcellulose (HEMC), hydroxyethylcarboxymethylcellulose (HECMC), and guar and guar derivatives and the like. A particularly preferred cellulose ether starting material is hydroxyethylcellulose.

The cationically modified, hydrophobically modified polysaccharide (such as a cellulose ether) of the instant invention is generally prepared through a sequence of reactions which are known in the prior art. A cellulose ether such as hydroxyethylcellulose is first reacted with a hydrophobic moiety such as cetylglycidylether to form the hydrophobically modified cellulose ether. This reaction is preferably conducted so that the hydrophobe content is in the range 0.5 to 2.5 weight percent, preferably from 1 to 2 weight percent. This hydrophobically modified cellulose ether is then reacted in a separate reaction with a quaternary ammonium salt such as glycidyltrimethyl ammonium chloride in order to add the cationic moiety to the backbone of the hydrophobically modified cellulose ether. In this step, a sufficient amount of the cationic moiety is added to the backbone cellulose ether so that the cationic degree of substitution (DS) is in the range 0.01 to 0.2, preferably 0.02 to 0.1.

The hydrophobe moieties are hydrocarbons of alkyl, aryl, alkenyl, or aralkyl groups having at least 14 carbon atoms, preferably at least 16 carbons in the chain. Generally, the upper limit of the carbon atoms of the hydrocarbon moiety is 24 carbon atoms, preferably 20 carbons, and more preferably 18 carbons. The hydrocarbon containing hydrophobe may be unsubstituted, i.e., simply a long chain alkyl group, or substituted with non-reactive groups such as aromatics, i.e., and aralkyl groups. Typical alkylating agents reactive with the cellulose ether hydroxyl groups include halides, epoxides, isocyanates, carboxylic acids, or acid halides.

The cellulose ethers are provided with the quaternary nitrogen-containing substituents through quaternization reactions that may be achieved by reacting the polysaccharides with quaternizing agents which are quaternary ammonium salts, including mixtures thereof, to effect substitution of the polysaccharide with quaternary nitrogen containing groups on the backbone. Typical quaternary ammonium salts that can be used include quaternary nitrogen containing halides, halohydrins, and epoxides. Examples of the quaternary ammonium salts include one or more of the following: 3-chloro-2-hydroxypropyl dimethyldodecyl ammonium chloride; 3-chloro-2-hydroxypropyl dimethylocetadecyl ammonium chloride; 3-chloro-2-hydroxypropyl dimethyloctyl ammonium chloride; 3-chloro-2-hydroxypropyl trimethyl ammonium chloride; 2-chloroethyl trimethyl ammonium chloride; 2,3-epoxypropyl trimethyl ammonium chloride; and the like. Preferred quaternization agents include 3-chloro-2-hydroxyupropyl trimethyl ammonium chloride; 3-chloro-2-hydroxypropyl dimethyloctadecyl ammonium chloride; 3-chloro-2-hydroxypropyl dimethyltetradecyl ammonium chloride; 3-chloro-2-hydroxypropyl dimethylhexadecyl ammonium chloride; 3-chloro-2-hydroxypropyl dimethyldodecyl ammonium chloride; and 3-chloro-2-hydroxypropyl dimethyloctadecyl ammonium chloride.

Quaternization can also be achieved using a two-step synthesis of (1) aminating the polysaccharide by reaction with an aminating agent, such as an amine halide, halohydrin or epoxide, followed by (2) quaternizing the product of step (1) by reaction with quaternizing agent, or mixtures thereof, containing a functioning group which forms a salt with the amine.

The molecular weight of the polymers is in the range 100,000 to 500,000 Da, preferably 150,000 to 400,000 Da more preferably 250,000 to 350,000 Da. While higher molecular weight polymers may possess viscosity modifying properties they are unsuitable for use in the fabric softening compositions of the invention as the compositions become more difficult to dispense and disperse in the rinse cycle of a washing machine.

Depending upon the target viscosity the polymer will generally be used in an amount of from 0.008 to 1.0% by weight, preferably 0.01 to 0.30% more preferably 0.02 to 0.2% by weight of the fabric softening composition.

Cationic Softening Agent

The cationic softening is generally one that is able to form a lamellar phase dispersion in water, in particular a dispersion of liposomes.

The cationic softening agent is typically a quaternary ammonium compound ("QAC"), in particular one having two $C_{12-28}$ groups connected to the nitrogen head group that may independently be alkyl or alkenyl groups, preferably being connected to the nitrogen head group by at least one ester link, and more preferably by two ester links.

The average chain length of the alkyl and/or alkenyl groups is preferably at least $C_{14}$ and more preferably at least $C_{16}$. It is particularly preferred that at least half of the groups have a chain length of $C_{18}$. In general, the alkyl and/or alkenyl groups are predominantly linear.

A first group of QACs suitable for use in the present invention is represented by formula (I):

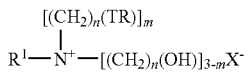

(I)

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T is generally O—CO. (i.e. an ester group bound to R via its carbon atom), but may alternatively be CO.O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulphate. Diesters variants of formula I (i.e. m=2) are preferred and typically have mono- and tri-ester analogues associated with them. Such materials are particularly suitable for use in the present invention.

Especially preferred agents are di-esters of triethanolammonium methylsulphate, otherwise referred to as "TEA ester quats.". Commercial examples include Tetranyl AHT-1, ex Kao, (a di-[hardened tallow ester] of triethanolammonium methylsulphate), AT-1 (di-[tallow ester] of triethanolammonium methylsulphate), and L5/90 (di-[palm ester] of triethanolammonium methylsulphate), both ex Kao, and Rewoquat WE18 (a di-tallow of triethanolammonium methylsulphate), ex Degussa.

The second group of QACs suitable for use in the invention is represented by formula (II):

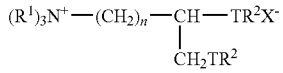

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; and wherein n, T, and $X^-$ are as defined above.

Preferred materials of this second group include 1,2 bis[tallowoyloxy]-3-trimethylammonium propane chloride, 1,2 bis[hardened tallowoyloxy]-3-trimethylammonium propane chloride, 1,2-bis[oleoyloxy]-3-trimethylammonium propane chloride, and 1,2bis[stearoyloxy]-3-trimethylammonium propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (III):

$$(R^1)_2—N^+—[(CH_2)_n\text{-}T\text{-}R^2]_2X^- \quad (III)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis(2-tallowoyloxyethyl)dimethyl ammonium chloride and hardened versions thereof.

A fourth group of QACs suitable for use in the invention is represented by formula (IV):

$$(R^1)_2—N^+—(R^2)_2X^- \quad (IV)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above. Preferred materials of this fourth group include di(hardened tallow)dimethylammonium chloride.

The iodine value of the softening agent is preferably from 0 to 120, more preferably from 0 to 100, and most preferably from 0 to 90. Essentially saturated material, i.e. having an iodine value of from 0 to 1, is used in especially high performing compositions. At low iodine values, the softening performance is excellent and the composition has improved resistance to oxidation and associated odour problems upon storage.

Iodine value is defined as the number of grams of iodine absorbed per 100 g of test material. NMR spectroscopy is a suitable technique for determining the iodine value of the softening agents of the present invention, using the method described in Anal. Chem., 34, 1136 (1962) by Johnson and Shoolery and in EP 593,542 (Unilever, 1993).

References to levels of cationic softening agent in this specification are to the total level of cationic softening agent, including all cationic components of a complex raw material that could enter the aqueous lamellar phase together. With a di-ester softening agent, it includes any associated mono-ester or tri-ester components that may be present.

For ease of formulation, the amount of softening agent is generally 50% or less, particularly 40% or less, and especially 30% or less by weight of the total composition. The preferred compositions contain from 0.5 to 8% by weight of softening agent.

Non-Ionic Surfactant

A non-ionic surfactant may be present in order to stabilise the composition, or perform other functions such as emulsifying any oil that may be present.

Suitable non-ionic surfactants include alkoxylated materials, particularly addition products of ethylene oxide and/or propylene oxide with fatty alcohols, fatty acids and fatty amines.

Preferred materials are of the general formula:

$$R—Y—(CH_2CH_2O)_z—H$$

Where R is a hydrophobic moiety, typically being an alkyl or alkenyl group, said group being linear or branched, primary or secondary, and preferably having from 8 to 25, more preferably 10 to 20, and most preferably 10 to 18 carbon atoms; R may also be an aromatic group, such as a phenolic group, substituted by an alkyl or alkenyl group as described above; Y is a linking group, typically being O, CO.O, or CO.N($R^1$), where $R^1$ is H or a $C_{1-4}$ alkyl group; and z represents the average number of ethoxylate (EO) units present, said number being 8 or more, preferably 10 or more, more preferably 10 to 30, most preferably 12 to 25, e.g. 12 to 20.

Examples of suitable non-ionic surfactants include the ethoxylates of mixed natural or synthetic alcohols in the "coco" or "tallow" chain length. Preferred materials are condensation products of coconut fatty alcohol with 15-20 moles of ethylene oxide and condensation products of tallow fatty alcohol with 10-20 moles of ethylene oxide.

The ethoxylates of secondary alcohols such as 3-hexadecanol, 2-octadecanol, 4-eicosanol, and 5-eicosanol may also be used. Exemplary ethoxylated secondary alcohols have formulae $C_{12}$-EO(20); $C_{14}$-EO(20); $C_{14}$-EO(25); and $C_{16}$-EO(30). Especially preferred secondary alcohols are disclosed in PCT/EP2004/003992 and include Tergitol-15-S-3.

Polyol-based non-ionic surfactants may also be used, examples including sucrose esters (such as sucrose monooleate), alkyl polyglucosides (such as stearyl monoglucoside and stearyl triglucoside), and alkyl polyglycerols.

Suitable cationic surfactants include single long chain ($C_{8-40}$) cationic surfactants. The single long chain cationic surfactant is preferably a quaternary ammonium compound comprising a hydrocarbyl chain having 8 to 40 carbon atoms, more preferably 8 to 30, most preferably 12 to 25 carbon atoms (e.g. quaternary ammonium compounds comprising a $C_{10-14}$ hydrocarbyl chain are especially preferred).

Examples of commercially available single long hydrocarbyl chain cationic surfactants which may be used in the compositions of the invention include: ETHOQUAD (RTM) 0/12 (oleylbis(2-hydroxyethyl)methylammonium chloride); ETHOQUAD (RTM) C12 (cocobis(2-hydroxyethyl)methyl ammonium chloride) and ETHOQUAD (RTM) C25 (polyoxyethylene(15)cocomethyl-ammonium chloride), all ex Akzo Nobel; SERVAMINE KAC (RTM), (cocotrimethylammonium methosulphate), ex Condea; REWOQUAT (RTM) CPEM, (coconutalkylpentaethoxymethylammonium methosulphate), ex Witco; cetyltrimethylammonium chloride; RADIAQUAT (RTM) 6460, (coconut oil trimethylammonium chloride), ex Fina Chemicals; NORAMIUM® MC50, (oleyltrimethylammonium chloride), ex Elf Atochem.

Optionally, the composition comprises an emulsifier that has an HLB of from 7 to 20, more preferably from 10 to 20, and most preferably from 15 to 20.

A particular surfactant may be useful in the present compositions alone or in combination with other surfactants. The preferred amounts of non-ionic surfactant indicated below refer to the total amount of such materials that are present in the composition.

When present, the total amount of non-ionic surfactant is generally from 0.05 to 10%, usually 0.1 to 5%, and often 0.35 to 3.5%, based on the total weight of the composition. If an oil is present in the composition, the weight ratio of the total amount of non-ionic surfactant to the amount of emulsified oil is preferably from 1:30 to 1:1, in particular from 1:25 to 1:5, and especially from 1:20 to 1:10.

Aqueous Base

The compositions of the invention are typically aqueous.

The aqueous base typically comprises 80% or greater by weight of water; sometimes this figure may rise to 90% or greater, or 95% or greater. The water in the aqueous base typically comprises 40% or greater by weight of the total formulation; preferably this figure is 60% or greater, more preferably it is 70% or greater.

The aqueous base may also comprise water-soluble species, such as mineral salts or short chain ($C_{1-4}$) alcohols. The mineral salts may aid the attainment of the desired viscosity for the composition, as may water soluble organic salts and cationic deflocculating polymers, as described in EP 41,698 A2 (Unilever). Such salts may be present at from 0.001 to 1% and preferably at from 0.005 to 0.1% by weight of the total composition. Examples of suitable mineral salts for this purpose include calcium chloride, magnesium chloride and potassium chloride. Short chain alcohols that may be present include primary alcohols, such as ethanol, propanol, and butanol, secondary alcohols such as isopropanol, and polyhydric alcohols such as propylene glycol and glycerol. The short chain alcohol may be added with cationic softening agent during the preparation of the composition.

Fatty Complexing Agent

A preferred additional component in the compositions of the present invention is a fatty complexing agent. Such agents typically have a $C_8$ to $C_{22}$ hydrocarbyl chain present as part of their molecular structure. Suitable fatty complexing agents include $C_8$ to $C_{22}$ fatty alcohols and $C_8$ to $C_{22}$ fatty acids; of these, the $C_8$ to $C_{22}$ fatty alcohols are most preferred. A fatty complexing agent is particularly valuable in compositions comprising a QAC having a single $C_{12-28}$ group connected to the nitrogen head group, such as mono-ester associated with a TEA ester quat. or a softening agent of formula II, for reasons of product stability and effectiveness.

Preferred fatty acid complexing agents include hardened tallow fatty acid (available as Pristerene, ex Uniqema).

Preferred fatty alcohol complexing agents include $C_{16}/C_{18}$ fatty alcohols (available as Stenol and Hydrenol, ex Cognis, and Laurex CS, ex Albright and Wilson) and behenyl alcohol, a $C_{22}$ fatty alcohol, available as Lanette 22, ex Henkel.

The fatty complexing agent may be used at from 0.1% to 10%, particularly at from 0.2% to 5%, and especially at from 0.3 to 2% by weight, based on the total weight of the composition.

Perfume

The compositions of the invention typically comprise one or more perfumes. The perfume is preferably present in an amount from 0.01 to 10% by weight, more preferably 0.05 to 5% by weight, most preferably 0.5 to 4.0% by weight, based on the total weight of the composition.

Co-Softener

Co-softeners may be used together with the cationic softening agent. When employed, they are typically present at from 0.1 to 20% and particularly at from 0.5 to 10%, based on the total weight of the composition. Preferred co-softeners include fatty esters, and fatty N-oxides.

Fatty esters that may be employed include fatty monoesters, such as glycerol monostearate, fatty sugar esters, such as those disclosed WO 01/46361 (Unilever).

Further Optional Ingredients

The compositions of the invention may contain one or more other ingredients. Such ingredients include preservatives (e.g. bactericides), pH buffering agents, perfume carriers, fluorescers, colourants, hydrotropes, antifoaming agents, anti-redeposition agents, soil-release agents, polyelectrolytes, enzymes, optical brightening agents, anti-shrinking agents, anti-wrinkle agents, anti-spotting agents, anti-oxidants, sunscreens, anti-corrosion agents, drape imparting agents, anti-static agents, ironing aids and dyes.

A particularly preferred optional ingredient is an opacifier or pearlescer. Such ingredients can serve to further augment the creamy appearance of the compositions of the invention.

Suitable materials may be selected from the Aquasol 0P30X range (ex Rohm and Haas), the PuriColour White range (ex Ciba) and the LameSoft ™ range (ex Cognis). Such materials are typically used at a level of from 0.01 to 1% by weight of the total composition.

Product Use

The compositions of the present invention are preferably rinse conditioner compositions and may be used in the rinse cycle of a domestic laundry process.

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Manufacture

The compositions according to the invention may be prepared by any of the means known in the art. In a preferred method of manufacture of a fabric softening composition, a solution of the polymer is prepared independently of a dispersion of the cationic fabric softening agent and the separate components are then mixed to provide a composition according to the invention. In practice, the polymer solution is post-dosed into the dispersion with mixing at ambient temperature. Alternatively, after the dispersion of the pre-melted cationic fabric softening agent into an aqueous base, the polymer solution can be added hot using methods known in the art.

Of course, it will be understood that the polymeric thickener can be used in any fabric treatment composition where a thick and creamy product which remains dispensable is desired.

EXAMPLES

The invention is further illustrated by the particular (non-limiting) examples described below. All amounts indicated are weight percentages of the total composition, unless otherwise indicated.

The polymers used in the Examples were as follows:

| polymer | Hydrophobe type | Hydrophobe wt % | Cat-DS | HE-MS | Approx. Mol wt |
|---|---|---|---|---|---|
| control | C16 | 0.6 | 0 | 3.3 | 370,000 Dalton |
| A | C16 | 1.35 | 0.05 | 3.91 | 440,000 Dalton |
| B | C16 | 1.35 | 0.01 | 3.91 | 440,000 Dalton |

Cat-DS is the degree of cationic substitution.

HE-MS is the extent of hydroxyethyl molar substitution.

The following formulations were prepared:

| Raw Material | Example A | Example 1 |
|---|---|---|
| HTTEAQ | 4.88% | 4.88% |
| Hydrenol D | 0.35% | 0.35% |

-continued

| Raw Material | Example A | Example 1 |
|---|---|---|
| Perfume | 0.3% | 0.3% |
| Polymer | 0.06% CP | 0.075% Polymer A |
| Minors (Dye, preservative) | | |
| Water | To 100% | To 100% |

HTTEAQ is hardened tallow triethanolamine quaternary based on reaction of approximately 2 moles of hardened tallow fatty acid with 1 mole triethanolamine; the subsequent reaction mixture being quaternised with dimethyl sulphate (final raw material is 85% active ingredients, the remaining 15% being IPA).

Hydrenol D is fully hardened $C_{16}$-$C_{18}$ fatty alcohol (100% active ingredients)ex Cognis.

The formulations were stored at different temperatures and the viscosity measured on a Haake Viscometer at a shear rate of $106^{s-1}$.

Example A

| Temperature | Time t = 0 (initial) | 1 wk | 4 wks | 9 wks | 12 wks |
|---|---|---|---|---|---|
| 5° C. | 142 | 120 | 120 | 120 | 120 |
| 20° C. | 142 | 130 | 138 | 143 | 141 |
| 37° C. | 142 | 130 | 137 | 67 | 148 |
| 40° C. | 142 | 128 | 145 | 88 | 93 |

Example 1

| Temperature | Time t = 0 (initial) | 1 wk | 4 wks | 8 wks | 10 wks | 12 wks |
|---|---|---|---|---|---|---|
| 5° C. | 125 | 166 | 160 | 180 | 174 | 174 |
| 20° C. | 125 | 182 | 150 | 170 | 174 | 172 |
| 37° C. | 125 | 208 | 160 | 174 | 165 | 140 |
| 40° C. | 125 | 195 | 148 | 160 | 140 | 140 |

Example A thickened with the Control Polymer starts to lose viscosity (up to 50%) for the reasons explained above; ie polymer detachment, hydrolysis of the active, and possibly even hydrolysis of the polymer backbone also. Conversely, the polymer thickened with the cationic, hydrophobically modified HEC maintains its viscosity up to 12 weeks at 40° C.

The following formulations were prepared:

| Raw Material | Example B | Example C | Example 3 | Example 4 |
|---|---|---|---|---|
| HTTEAQ | 4.88% | 4.88% | 4.88% | 4.88% |
| Hydrenol D | 0.35% | 0.35% | 0.35% | 0.35% |
| Perfume | 0.3% | 0.3% | 0.3% | 0.3% |
| Polymer | 0.05% CP | 0.131% CP | 0.15% Polymer B | 0.20% Polymer B |
| Silicone | — | 2.78% | — | 2.78% |
| Minors (Dye, preservative) | | | | |
| Water | To 100% | To 100% | To 100% | To 100% |

Silicone is a high molecular weight PDMS silicone oil (60% silicone oil) emulsified with nonionic ethoxylate surfactants as described in WO03022969 A1.

Example B

| Temperature | Time t = 0 (initial) | 1 wk | 2 wks | 4 wks | 8 wks | 12 wks |
|---|---|---|---|---|---|---|
| 5° C. | 165 | — | — | — | 102 | 98 |
| 20° C. | 165 | 106 | 105 | 101 | 111 | 121 |
| 37° C. | 165 | 120 | 122 | 130 | 50 | 85 |
| 41° C. | 165 | 126 | 120 | 129 | 63 | gel |

Example C

| Temperature | Time t = 0 (initial) | 1 wk | 2 wks | 4 wks | 8 wks | 12 wks |
|---|---|---|---|---|---|---|
| 5° C. | 150 | — | 125 | — | — | 126 |
| 20° C. | 150 | 107 | 98 | — | 30 | 56 |
| 37° C. | 150 | 158 | — | 105 | 34 | 30 |
| 41° C. | 150 | 165 | 167 | 80 | 30 | 315 |

Example 3

| Temperature | Time t = 0 (initial) | 1 wk | 2 wks | 4 wks | 8 wks | 12 wks |
|---|---|---|---|---|---|---|
| 5° C. | 136 | 137 | 130 | 144 | 140 | 140 |
| 20° C. | 136 | 149 | 128 | 130 | 120 | 120 |
| 37° C. | 136 | 120 | 124 | 131 | 130 | 104 |
| 41° C. | 136 | 123 | 127 | 138 | 90 | 105 |

Example 4

| Temperature | Time t = 0 (initial) | 1 wk | 2 wks | 4 wks | 8 wks | 12 wks |
|---|---|---|---|---|---|---|
| 5° C. | 201 | 260 | 252 | 253 | 260 | 270 |
| 20° C. | 201 | 228 | 227 | 235 | 250 | 255 |
| 37° C. | 201 | 246 | 223 | 206 | 200 | 197 |
| 41° C. | 201 | 247 | 220 | 195 | 182 | 150 |

Comparison of Example 3 with Example B and Example 4 with Example C shows a clear high temperature stability benefit from the use of the cationically modified polymers. The amount of viscosity loss at high temperatures is significantly reduced prior to the onset of gellation.

The invention claimed is:

1. An aqueous fabric softening composition comprising a cationic fabric softening compound and water soluble polysaccharide polymers comprising hydrophobic groups selected from aryl, alkyl, alkenyl, aralkyl each having at least 14 carbon atoms and cationic quaternary ammonium salt groups such that the cationic degree of substitution is from 0.01 to 0.2, the polymers having a molecular weight in the range from 100,000 to 700,000.

2. An aqueous fabric softening composition as claimed in claim 1 in which the hydrophobic groups comprise at least 16 carbon atoms.

3. An aqueous fabric softening composition as claimed in claim 1 or claim 2 in which the cationic degree of substitution is from 0.02 to 0.1.

4. An aqueous fabric softening composition as claimed in claim 1 in which the polymer has a molecular weight of at least 150,000 Da.

5. An aqueous fabric softening composition as claimed in claim 4 in which the hydrophobic groups comprise alkyl groups of 16 carbon atoms.

6. An aqueous fabric softening composition as claimed in claim 1 in which the hydrophobic group comprise from 1.0 to 2.5% by weight of the polymer.

7. An aqueous fabric softening composition as claimed in claim 1 in which the polymer has a molecular weight of from 250,000 to 550,000 Da.

8. An aqueous fabric softening composition as claimed in claim 1 in which the polymer is present in an amount of from 0.008 to 1% by weight of the composition.

9. An aqueous fabric softening composition as claimed in claim 8 in which the polymer is present in an amount of from 0.002 to 0.3% by weight of the composition.

10. An aqueous fabric softening composition as claimed in claim 1 in which the fabric softening compound is a quaternary ammonium compound.

11. An aqueous fabric softening composition as claimed claim 10 in which the fabric softening compound comprises a quaternary ammonium compound with ester linkages.

12. An aqueous fabric softening composition as claimed in claim 11 in which the fabric softening compound comprises a tallow based triethanolamine ammonium compound.

13. An aqueous fabric softening composition as claimed in claim 1 in which the fabric softening compound is present in an amount of from 0.5 to 8% by weight of the composition.

14. An aqueous fabric softening composition as claimed in claim 1 which additionally comprises a fatty alcohol or fatty acid containing from 8 to 22 carbon atoms.

15. An aqueous fabric softening composition as claimed in claim 14 which comprises from 0.3 to 2% by weight of a $C_{16}$-$C_{18}$ fatty alcohol.

* * * * *